US010358810B2

(12) United States Patent
Saito et al.

(10) Patent No.: US 10,358,810 B2
(45) Date of Patent: Jul. 23, 2019

(54) DISCHARGE SOCKET AND FLUSH TOILET HAVING SAME

(71) Applicant: TOTO LTD., Kitakyushu-shi, Fukuoka (JP)

(72) Inventors: Haruka Saito, Kitakyushu (JP); Hiroshi Tomonari, Kitakyushu (JP); Hideto Tomiyoshi, Kitakyushu (JP); Isami Sakaba, Kitakyushu (JP); Shigeru Okada, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/073,000

(22) Filed: Mar. 17, 2016

(65) Prior Publication Data

US 2016/0273207 A1 Sep. 22, 2016

(30) Foreign Application Priority Data

Mar. 20, 2015 (JP) ..... 2015-057516
Jan. 22, 2016 (JP) ..... 2016-011025

(51) Int. Cl.

*E03D 11/17* (2006.01)
*E03D 11/16* (2006.01)
*E03D 11/13* (2006.01)
*E03D 11/02* (2006.01)

(52) U.S. Cl.

CPC ..... *E03D 11/17* (2013.01); *E03D 11/13* (2013.01); *E03D 11/16* (2013.01); *E03D 11/02* (2013.01)

(58) Field of Classification Search

CPC ..... E03D 11/02; E03D 11/13; E03D 11/16; E03D 11/17; E03D 11/18
USPC ..... 4/420–424; 285/56
See application file for complete search history.

(56) References Cited

U.S. PATENT DOCUMENTS 728,985 A * 5/1903 Ryan ..... E03D 5/00 285/119
2,055,490 A * 9/1936 Groeniger ..... E03D 11/18 285/180
5,819,326 A * 10/1998 Kobayashi ..... B28B 1/261 285/148.22
6,292,956 B1 * 9/2001 Kayahara ..... B28B 1/261 4/420

FOREIGN PATENT DOCUMENTS

JP 2011-179187 9/2011

* cited by examiner

*Primary Examiner* — Erin Deery
(74) *Attorney, Agent, or Firm* — Baker & Hostetler LLP

(57) ABSTRACT

The present invention is a discharge socket connecting a toilet main body and a discharge pipe. The discharge socket has a vertical conduit portion; and a bent conduit portion including an inflow port connected to the vertical conduit portion; an outflow port, connected to an inlet port of the discharge pipe; and a flow path, the flow path having a bent portion. A projecting portion is disposed on the bent portion, the projecting portion forming a projecting space which projects outward from the flow path. The projecting portion is formed so that the flow direction of discharge water flowing from the bent conduit portion into the inlet portion of the discharge pipe is changed to the center direction of the discharge pipe by the discharge water returning to the projecting space after flowing from the flow path into the projecting space.

5 Claims, 8 Drawing Sheets

DISCHARGE SOCKET AND FLUSH TOILET HAVING SAME

TECHNICAL FIELD

The present invention relates to a discharge socket and a flush toilet having same, and more particularly to a discharge socket connecting a discharge port of a toilet main body and a discharge pipe having a bent portion installed under a floor surface.

BACKGROUND ART

Conventionally, wash-down flush toilets have been known as toilets which do not create a siphon effect. Compared to siphon-type flush toilets which discharge waste by the siphon effect, such conventional wash-down flush toilets push waste out by the water flow effect caused by a water drop, and therefore have a simple structure, are low in cost, and do not create a siphon effect, thereby yielding the advantage that the flush water volume used by the flush toilet can be kept low. The wash-down type of flush toilet also conforms to the long standing requirement to conserve water in toilets.

For example, a discharge socket connecting the discharge path of a wash-down flush toilet main body and an under-floor discharge pipe is known (see patent literature 1). The discharge socket has a toilet main body-side connecting member connected to the outlet portion on the discharge path of a toilet main body; an under-floor-side connecting pipe member connected to an under-floor discharge pipe inlet portion and a bent conduit, and an intermediate pipe member extending in essentially a straight line connecting a toilet main body-side connecting pipe member and an under-floor-side connecting pipe member.

In the discharge socket shown in patent literature 1, when discharge water seals the discharge socket bent conduit interior produces a siphon effect, a negative pressure is created which seeks to pull upstream side discharge water into the downstream side, therefore to prevent this, a negative pressure constraining means is disposed in the bent conduit of the discharge socket.

CITATION LIST

Patent Literature

Patent Literature 1: Japanese Patent Unexamined Publication No. 2011-179187

SUMMARY OF INVENTION

Technical Problem

Here, referring to FIG. 9, a flush toilet in which a conventional common discharge socket is applied to an under-floor discharge pipe including a bent portion is explained. FIG. 9 is a cross sectional view schematically showing a wash-down flush toilet including a conventional discharge socket, and the flow of discharge water in an under-floor discharge pipe including a bent portion.

As shown in FIG. 9, a conventional discharge socket 160 connects the drain path 140 on the toilet main body 120 of a wash-down flush toilet 100 to an under-floor drain pipe 180 including a bent portion 180*a* in which the flow path bends from the upstream toward the downstream. The discharge socket 160 has a toilet main body-side connecting pipe member 200 connected to the outlet portion of the toilet main body 120 drain path 140, an under-floor-side connecting pipe member 240 having a bent conduit connected to the inlet portion of the under-floor drain pipe 180, and an intermediate pipe member 220 extending in essentially a straight line and connecting the toilet main body-side connecting pipe member 200 and the under-floor-side connecting pipe member 240. When flush water is discharged from the train path 140 of the toilet main body 120 to the discharge socket 160 together with waste, the flush water is discharged to the under-floor-side connecting pipe member 240 through the toilet main body-side connecting pipe member 200 of the discharge socket 160 and intermediate pipe member 220. Flush water discharged to the under-floor-side connecting pipe member 240 flows down within the under-floor drain pipe 180 along the front wall surface 180*b* of the under-floor drain pipe 180 on the front side of the toilet main body 120 in FIG. 9 due to the force of water in the horizontal direction. Flush water flowing down along the front wall surface 180*b* on the front side of the under-floor drain pipe 180 of the toilet main body 120 forms a water seal of flow path in the bent portion 180*a* of the under-floor drain pipe 180, so that flush water discharged to the under-floor drain pipe 180 accumulates in the bent portion 180*a* of the under-floor drain pipe 180. Flush water discharged to the under-floor drain pipe 180 in this manner blocks the flow path of the bent portion 180*a* of the under-floor drain pipe 180, creating a sealed space. Therefore in some cases, this sealed space is pulled by discharge water into a negative pressure state so that a siphon occurs. This results in the concern that seal water in the toilet main body 120 will be pulled downstream, breaking the seal or reducing seal water.

If the seal of toilet main body seal water is in this way broken, or seal water is reduced, that amount of flush water must be added, which contravenes the long-established need to conserve flush water in flush toilets.

It is therefore an object of the present invention to provide a discharge socket capable of preventing an occurrence of siphoning caused by water sealing of the flow path in a bent portion of a discharge pipe installed on a floor surface, and providing a flush toilet having same.

Solution to Problem

The above object is achieved according to the present invention by providing a discharge socket connecting a discharge port of a toilet main body and a discharge pipe including a bent portion disposed under a floor surface, comprising: a vertical conduit portion, connected to the discharge port of a toilet main body, through which discharge water flows vertically downward from the discharge port of the toilet main body; and a bent conduit portion including an inflow port connected to the vertical conduit portion; an outflow port, connected to an inlet port of the discharge pipe, a center axis of the outflow port of the bent conduit portion being separated in the horizontal direction from a center axis of the vertical conduit portion; and a flow path through which the discharge water flows from the inflow port of the bent conduit portion to the outflow port of the bent conduit portion, the flow path having a bent portion which bends from the vertical conduit portion side toward the outflow port of the bent conduit portion; wherein a projecting portion is disposed on the bent portion of the bent conduit portion, the projecting portion forming a projecting space which projects outward from the flow path extending from an end portion on the side of the vertical conduit portion to a side other than the side of the vertical conduit portion, and the projecting portion is formed so that the flow direction of discharge water flowing from the bent conduit portion into the inlet portion of the discharge pipe is changed to the center direction of the discharge pipe by the discharge water returning to the projecting space after flowing from the flow path into the projecting space.

In the discharge socket thus constituted, a projecting portion is disposed on the bent portion of the bent conduit portion, the projection portion forming a projecting space which projects outward from the flow path extending from the end portion on the side of the vertical conduit portion to the side other than the side of the vertical conduit portion, and the projecting portion is formed so that the flow direction of discharge water flowing from the bent conduit portion into the inlet portion of the discharge pipe is changed to the center direction of the discharge pipe by the discharge water returning to the projecting space after flowing from the flow path into the projecting space, therefore a portion of water discharged from the discharge port of the toilet main body to the bent conduit portion of the discharge socket through the vertical conduit portion flows into the projecting space formed by the projecting portion. Discharge water which has flowed into the projecting portion flows toward the center direction of the discharge pipe, therefore the direction of discharge water flowing into the discharge pipe without passing from the bent conduit portion of the discharge socket through the projecting portion (discharge water seeking to flow along the wall surface of the discharge pipe) is changed to the center direction of the discharge pipe, and discharge water can more easily drop down the center of the discharge pipe. As a result, according to the discharge socket of the present invention, accumulation of discharge water in the bent portion of the discharge pipe under the floor so as to block (water seal) the flow path can be prevented, and the occurrence of siphoning can be prevented.

In a preferred embodiment of the present invention, the projecting portion on the bent portion of the bent conduit portion is disposed on the opposite side from the side of the vertical conduit portion, sandwiching the center axis of the outflow port of the bent conduit portion.

In the embodiment of the present invention thus constituted, the projecting portion on the bent portion of the bent conduit portion is disposed on the opposite side from the side of the vertical conduit portion, sandwiching the center axis of the outflow port of the bent conduit portion, therefore water flowing into the bent conduit portion through the vertical conduit portion can more easily flow into the projecting space formed by the projecting portion. Since water flowing into the projecting portion flows toward the center direction of the discharge pipe, the direction of discharge water (the mainstream) flowing along the wall surface of the discharge pipe can be changed to a discharge pipe center direction, and discharge water can more easily drop more to the center of the discharge pipe. As a result, according to the embodiment of the present invention, accumulation of discharge water in the bent portion of the discharge pipe under the floor and blocking of the flow path can be prevented, and the occurrence of siphoning can be still further prevented.

In another preferred embodiment of the present invention, the projecting portion on the bent portion of the bent conduit portion is disposed above of the flow path along the center axis of the outflow port of the bent conduit portion.

In the embodiment of the present invention thus constituted, the projecting portion on the bent portion of the bent conduit portion is disposed above the flow path along the center axis of the outflow port of the bent conduit portion, therefore water flowing into the bent conduit portion through the vertical conduit portion can more easily flow into the projecting space formed by the projecting portion. Since water flowing into the projecting portion flows toward the center direction of the discharge pipe, the direction of discharge water (the mainstream) flowing along the wall surface of the discharge pipe can be changed to the center direction of the discharge pipe, and discharge water can more easily drop more in the center of the discharge pipe. As a result, according to the embodiment of the present invention, accumulation of discharge water in the bent portion of the discharge pipe under the floor and blocking of the flow path can be prevented, and the occurrence of siphoning can be still further prevented.

In still another embodiment of the present invention, the projecting portion on the bent portion of the bent conduit portion is disposed on the opposite side from the side of the vertical conduit portion, sandwiching the center axis of the outflow port of the bent conduit portion, and above a flow path along the center axis of the outflow port of the bent conduit portion.

In the embodiment of the present invention thus constituted, the projecting portion on the bent portion of the bent conduit portion is disposed on the opposite side from the side of the vertical conduit portion, sandwiching the center axis of an outflow port of the bent conduit portion, and above the flow path along the center axis of the outflow port of the bent conduit portion, therefore water flowing into the bent conduit portion through the vertical conduit portion can more easily flow into the projecting space formed by the projecting portion. Since water flowing into the projecting portion flows toward the center direction of the discharge pipe, the direction of discharge water (mainstream) flowing along the wall surface of the discharge pipe can be changed to center direction of the discharge pipe, and discharge water can more easily drop more in the center of the discharge pipe. As a result, according to the embodiment of the present invention, accumulation of discharge water in the bent portion of the discharge pipe under the floor and blocking of the flow path can be prevented, and the occurrence of siphoning can be still further prevented.

In another embodiment of the present invention, volume of the projecting space in the bent conduit portion is greater than volume of a virtual cylinder formed inside the flow path by projecting an opening cross section in the horizontal direction of the outflow port of the bent conduit portion, from the height position of the bottom surface of the bent conduit portion to the height position at the height of the top surface of the bent conduit portion.

In the embodiment of the present invention thus constituted, the volume of the projecting space in the bent conduit portion is greater than the volume of a virtual cylinder formed inside the flow path by projecting the opening cross section in the horizontal direction of the outflow port of the bent conduit portion, from the height position of the bottom surface of the bent conduit portion to the height position at the height of the top surface of the bent conduit portion, therefore the volume of water flowing in reverse from the projecting space increases, and the force acting to change the direction of discharge water flowing along the wall surface of the discharge pipe (acting to cancel out the orientation and force of the mainstream) increases. As a result, according to the embodiment of the present invention, the mainstream of discharge water falls down the center of the discharge pipe, not flowing along the wall surface of the discharge pipe, therefore water sealing of the bent portion of the discharge pipe under the floor can be constrained.

In another embodiment of the present invention, a pitched surface, sloping downward toward the outflow port of the bent conduit portion, is formed on the bottom surface of the projecting space of the bent conduit portion.

In the embodiment of the present invention thus constituted, a pitched surface, pitched downward toward the outflow port of the bent conduit portion, is formed on the bottom surface of the projecting space of the bent conduit portion, therefore water which has flowed into the projecting portion can more easily flow into the discharge pipe. Water flowing into the projecting portion can be prevented from accumulating in the projecting space without flowing into the discharge pipe, and smooth discharge from the discharge socket to the discharge pipe can be performed. Also, since the flow speed of reverse flowing water from the projecting space is increased by the forming of a pitched surface on the bottom surface of the projecting portion, the force causing the direction of discharge water flowing along the wall surface of the discharge pipe to change to the center direction of the discharge pipe (acting to cancel the orientation and force of the mainstream) increases, and the mainstream of discharge water falls down the center of the discharge pipe without flowing along the wall surface of the discharge pipe, therefore water sealing of the bent portion of the discharge pipe under the floor can be constrained.

The above object is achieved according to the present invention by providing a flush toilet comprising the discharge socket described above.

In the present invention thus constituted, the occurrence of siphoning caused by water sealing of the flow path of the bent portion of the discharge pipe in the discharge socket of a flush toilet can be prevented.

Advantageous Effects of Invention

According to the discharge socket and the flush toilet having the discharge socket of the present invention, the occurrence of siphoning caused by water sealing of the flow path of the bent portion in the discharge pipe installed under a floor can be prevented.

DESCRIPTION OF EMBODIMENTS

Below, referring to the attached drawings, it is explained a discharge socket and a flush toilet having same according to embodiments of the present invention.

(First Embodiment)

Flush Toilet

Figure 1:
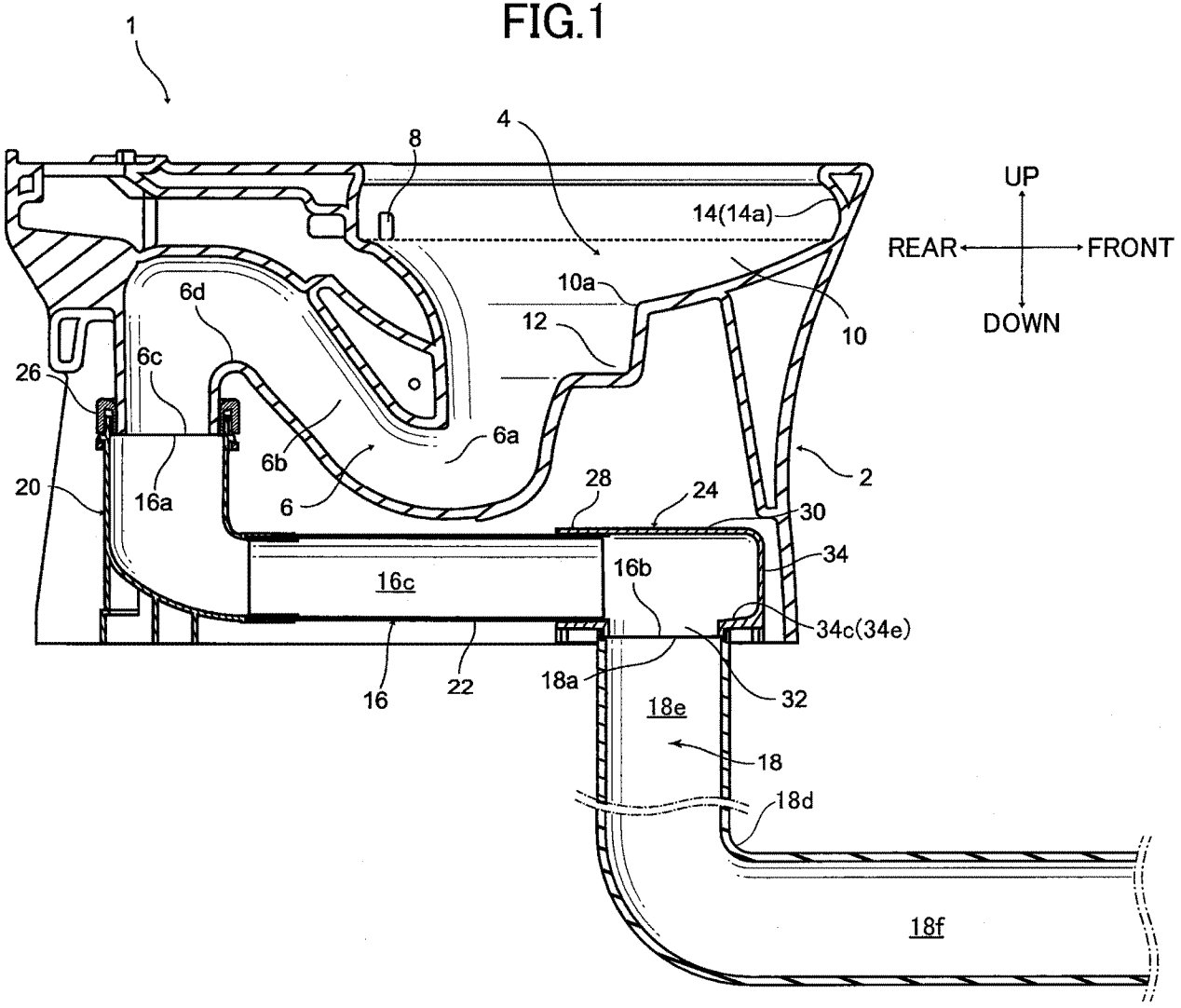
FIG. 1 is a cross sectional view showing a wash-down flush toilet having a discharge socket according to a first embodiment of the present invention.

First, referring to FIG. 1, a wash-down flush toilet having a discharge socket according to a first embodiment of the present invention is explained. FIG. 1 is a cross sectional view showing a wash-down flush toilet having a discharge socket according to a first embodiment of the present invention.

As shown in FIG. 1, a flush toilet 1 comprises a toilet main body 2, and a reservoir tank (not shown), which is a flush water supply for storing flush water used for toilet flushing, supplying it to the toilet main body 2. Formed on the toilet main body 2 are a bowl-shaped bowl portion 4 for receiving waste, a discharge trap conduit 6 extending from the bottom portion of the bowl portion 4, a jet spout port (not shown), and a rim spout port 8 for rim spouting.

In the present embodiment, the direction along the floor surface on which wash-down flush toilet 1 is disposed is referred to as the horizontal direction, and the direction perpendicular thereto as the vertical direction.

The side on which the wash-down flush toilet 100 is placed relative to the floor surface is referred to as the upward direction (up); the side opposite this is referred to as the downward direction (down); the side on which the discharge trap conduit 6 is placed relative to the bowl portion 4 of the wash-down flush toilet is referred to as the rear direction (rear); the side opposite this is referred to as the front direction (front); the side on the right side relative to the rear direction among the directions perpendicular to the up-down direction and the front-rear direction is referred to as the right direction (right); and the left side thereof is referred to as the left direction (left).

The bowl portion 4 comprises a bowl-shaped waste receiving surface 10, an indented portion 12 formed downward from a bottom edge portion 10*a* of the bowl-shaped waste receiving surface 10 and connected to the indented portion 12, and a rim portion 14 formed along the top edge portion of the bowl portion 4. The jet spout port (not shown) is formed on the side wall surface at the left side of the bowl portion 4 indented portion 12 as seen from the front side of the toilet main body 2. The mainstream of flush water spouted from the jet spout port flows in toward the indented portion 12 and circulates.

The rim spout port 8 is formed at the top portion rear of the bowl portion 4, and flush water is spouted from the rim spout port 8 forward along the inside perimeter surface 14*a* of the rim portion 14 formed on the top portion of the bowl portion 4. Flush water spouted from the rim spout port 8 forms a circulating flow which circulates on the waste receiving surface 10, then flows into the indented portion 12.

An inlet portion 6*a* of the discharge trap conduit 6 is opened at the rear and under the indented portion 12 on the waste receiving surface 10 of the bowl portion 4. An ascending conduit 6*b* extends upward and rearward of the inlet portion 6*a*, and a descending conduit outlet portion 6*c* (discharge port of toilet main body), descending vertically downward from the ascending conduit 6*b*, continues there from. Between the ascending conduit 6*b* and the descending conduit outlet portion 6*c* is a peak portion 6*d*.

Here, an under-floor discharge pipe 18 is disposed under the floor surface. An inlet portion 18*a* is opened on the under-floor discharge pipe 18, and a bent portion 18*d* is formed between a vertical portion 18*e* and a horizontal portion 18*f*. A discharge socket 16 for discharging waste is connected to the descending conduit outlet portion 6*c* of the discharge trap conduit 6 and the inlet portion 18*a* on the under-floor discharge pipe 18. The discharge socket 16 comprises an inflow port 16*a* connected to the descending conduit outlet portion 6*c* of the discharge trap conduit 6, and an outflow port 16*b* connected to the inlet portion 18*a* of the under-floor discharge pipe 18. A flow path 16*c* for passing flush water containing waste from the inflow port 16*a* to the outflow port 16*b* is formed on the discharge socket 16. Flush water containing waste discharged from the toilet main body 2 is discharged from the outflow port 16*b* of the discharge socket 16 to the under-floor discharge pipe 18 disposed under the floor.

Discharge Socket

Figure 2:
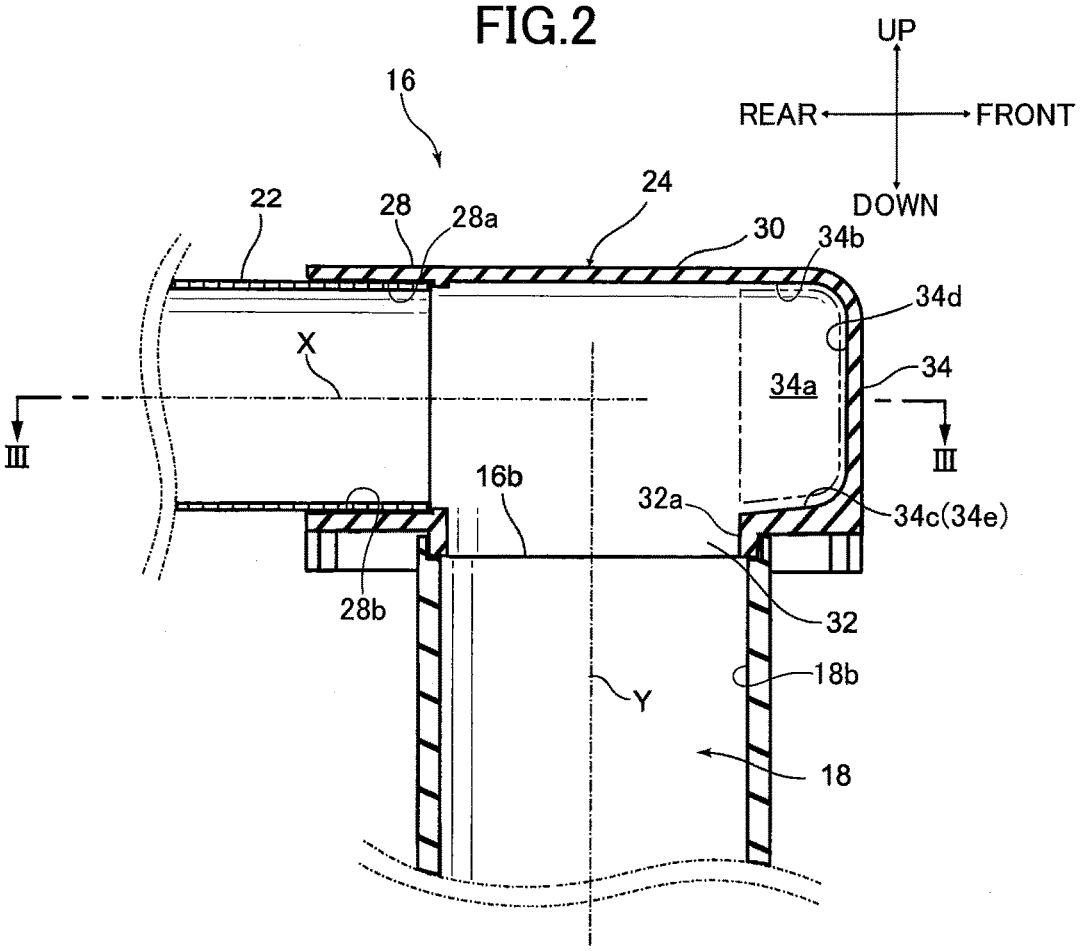
FIG. 2 is a cross sectional view showing a under-floor plumbing side connecting pipe portion of a discharge socket according to the first embodiment of the present invention.
Figure 3:
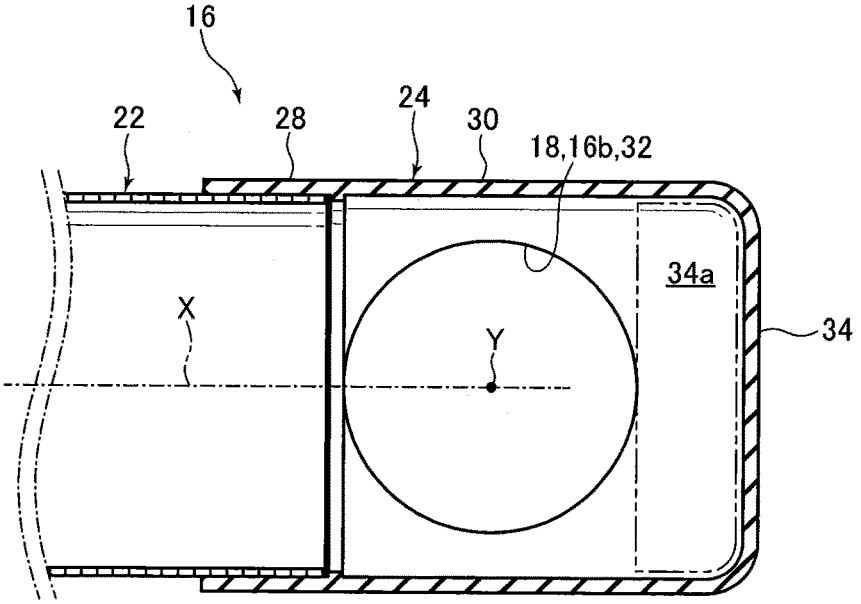
FIG. 3 is a cross sectional view seen along line in FIG. 2.

Next, referring to FIGS. 1 through 3, the discharge socket 16 in a wash-down flush toilet 1 according to the present embodiment is explained. FIG. 2 is a cross sectional view showing a discharge socket under-floor plumbing-side connecting pipe portion in a first embodiment of the present invention; FIG. 3 is a cross sectional view seen along line III-Ill in FIG. 2. Note that in FIG. 2 the center axis of the under-floor plumbing-side connecting pipe portion 24 straight pipe portion 28 is shown by X, and the center axis of the outflow port 16*b* and vertical portion 32 is shown by Y.

As shown in FIGS. 1 through 3, the discharge socket 16 comprises a toilet main body-side connecting pipe portion (vertical conduit portion) 20, connected in the vertical downward direction to the descending conduit outlet portion 6*c* of the discharge trap conduit 6 on the toilet main body 2, and formed to bend toward the horizontal direction from the vertical downward direction; an intermediate pipe portion 22, connected to the toilet main body-side connecting pipe portion 20 and extending in a straight pipe-shape horizontally from the toilet main body-side connecting pipe portion 20; and an under-floor plumbing-side connecting pipe portion (bent conduit portion) 24, connected to the intermediate pipe portion 22 and formed to bend from the horizontal direction toward the vertical downward direction.

An inflow port 16*a* connected to the descending conduit outlet portion 6*c* of the discharge trap conduit 6 is provided on the toilet main body-side connecting pipe portion 20, and discharge water flowing in from the inflow port 16*a* flows vertically downward. The toilet main body-side connecting pipe portion 20 is formed so that the flow path inside the toilet main body-side connecting pipe portion 20 bends from the vertical upstream side to the horizontal downstream side. The intermediate pipe portion 22 is connected on the downstream side of the toilet main body-side connecting pipe portion 20.

The inflow port 16*a* disposed on the toilet main body-side connecting pipe portion 20 is connected through a rubber joint 26 to the descending conduit outlet portion 6*c*, which opens in the vertically downward direction on the discharge trap conduit 6 of the toilet main body 2.

The intermediate pipe portion 22 is a straight pipe portion extending horizontally; the toilet main body-side connecting pipe portion 20 is connected on the upstream side of the intermediate pipe portion 22. The under-floor plumbing-side connecting pipe portion 24 is connected on the downstream side of the intermediate pipe portion 22.

The under-floor plumbing-side connecting pipe portion 24 has an outflow port 16*b* on bottom portion thereof, and has: a straight pipe portion 28 connected to the intermediate pipe portion 22 and extending horizontally; a bent portion 30, in which the flow path bends from the straight pipe portion 28 toward the outflow port 16*b*; and a vertical portion 32 extending in the vertically downward direction from this bent portion 30. An outflow port 16*b* is provided on the vertical portion 32, which is the bottom portion of the under-floor plumbing-side connecting pipe portion 24. The center axis Y of the outflow port 16*b* is an opening which is separated in the horizontal direction from the center axis of the vertical pipe of the toilet main body-side connecting pipe portion 20; the outflow port 16*b* is connected to the inlet portion 18*a* of the under-floor discharge pipe 18.

A projecting portion 34 projecting horizontally toward the front from the center axis Y of the outflow port 16*b* is disposed on the bent portion 30 of the under-floor plumbing-side connecting pipe portion 24. A projecting space 34*a* (the space surrounded by the double dot and dash line in FIGS. 2 and 3), communicating with the bending flow path of bent portion 30, is formed on the interior of the projecting portion 34. More specifically, as shown in FIGS. 2 and 3, the projecting space 34*a* on the projecting portion 34 is a space which communicates with the bent flow path of the bent portion 30, which projects further forward than the wall surface 32*a* on the front side of the vertical portion 32 in FIGS. 2 and 3.

In the bent portion 30 of the under-floor plumbing-side connecting pipe portion 24, the projecting portion 34 is placed at a position opposing the straight pipe portion 28 side, sandwiching the center axis Y of the outflow port 16*b*. Namely, in the bent portion 30, the projecting portion 34 is formed at the same height position as the height position at which the straight pipe portion 28 is formed, and the top surface 34*b* of the projecting portion 34 and the top surface 28*a* of the straight pipe portion 28, and the bottom surface 34*c* of the projecting portion 34 and the bottom surface 28*b* of the straight pipe portion 28 are respectively formed at the same height positions. Note that "same height position" includes cases of exact matching and cases of being essentially matched enough that the same effect is imparted.

The top surface 34*b* of the projecting portion 34 is formed so that the top surface 28*a* of the straight pipe portion 28 is extended horizontally in a direction oriented from the straight pipe portion 28 toward the bent portion 30 (the front direction of the bent portion 30 in FIG. 2). A wall surface 34*d* of the projecting portion 34 is formed, facing vertically downward from the top surface 34*b* of the projecting portion 34. The wall surface 34*d* of the projecting portion 34 sandwiches the center axis Y of the outflow port 16*b*, and is positioned in a direction further separated from the center axis Y of the outflow port 16*b* than the position opposite the straight pipe portion 28 side (the end portion on the front side of the straight pipe portion 28 in FIG. 2). From the bottom end of the wall surface 34*d* of the projecting portion 34, the bottom surface 34*c* of the projecting portion 34 is formed toward the vertical portion 32, and is connected to the vertical portion 32. The conduit cross section of the straight pipe portion 28 in the plane perpendicular to the center axis C of the straight pipe portion 28 has essentially the same shape as the conduit cross section of the projecting portion 34.

A pitched surface 34*e* sloping downward toward the outflow port 16*b* is formed on the bottom surface 34*c* of the projecting space 34*a* on projecting portion 34.

Operation and Effect

Figure 4:
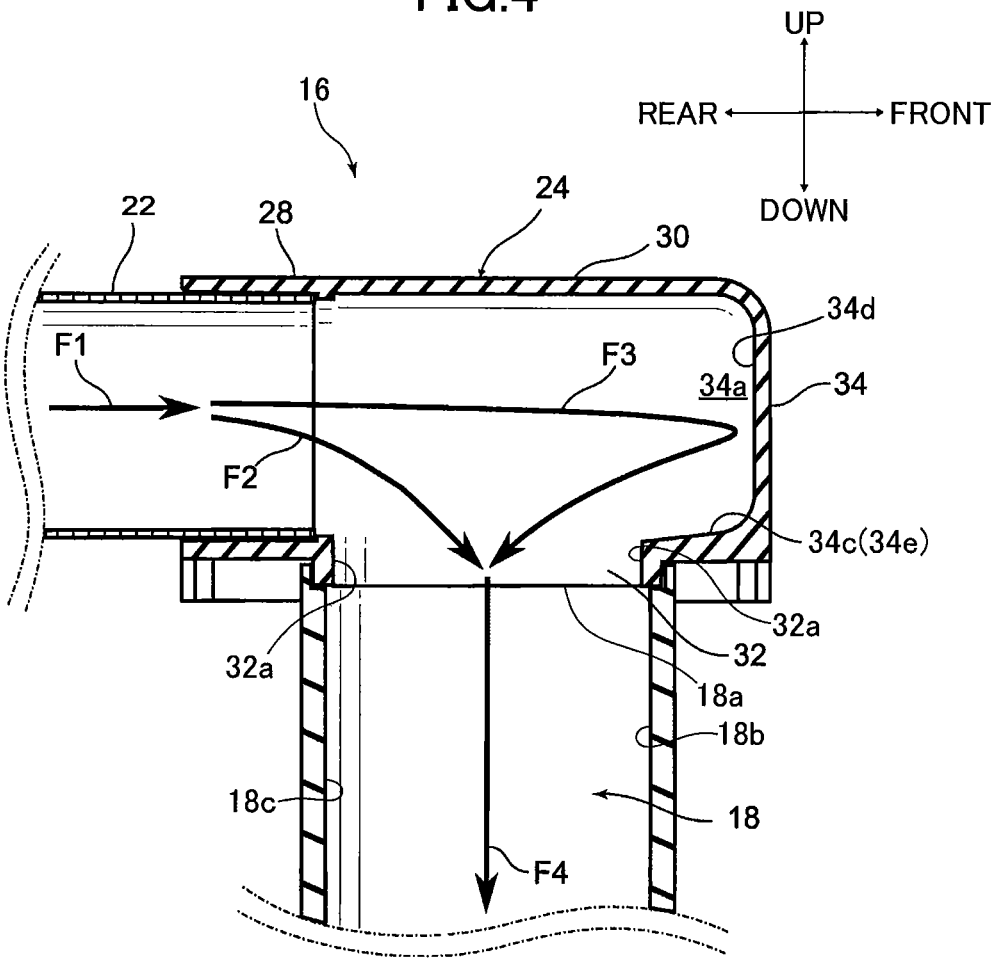
FIG. 4 is a cross sectional view showing of the under-floor-side connecting pipe portion schematically showing the flow of flush water in the under-floor-side connecting pipe portion of a discharge socket in the first embodiment of the present invention.

Next, referring to FIGS. 1 through 4, the operation and effect of a discharge socket 16 according to the first embodiment of the present invention is explained. FIG. 4 is cross sectional view of the under-floor-side connecting pipe portion, schematically showing the flow of flush water in the under-floor plumbing-side connecting pipe portion of the discharge socket according to the first embodiment of the present invention. Note that in FIG. 4 the directions of flow of flush water containing waste and flowing in the under-floor plumbing-side connecting pipe portion 24 are respectively indicated by F1 through F4.

First, when a toilet flush is started by instruction from an operating portion, not shown, flush water in a reservoir tank (not shown) is respectively spouted from a rim spout port 8 and a jet spout port (not shown) on the bowl portion 4. With respect to flush water spouted from the rim spout port 8 and the jet spout port, after the interior of the bowl portion 4 of the toilet main body 2 has been flushed by the circulating flow, waste is discharged from the inlet portion 6*a* of the discharge trap conduit 6 to the ascending pipe 6*b* by the flow effect resulting from water drop. Flush water discharged together with waste into the ascending conduit 6*b* rises in the ascending pipe 6*b* and is caused to flow toward the descending pipe outlet portion 6*c*.

Flush water discharged together with waste toward the descending pipe outlet portion 6*c* (flush water discharged with waste is referred to below simply as "waste water") flows down into the toilet main body-side connecting pipe portion 20 through the inflow port 16*a* on the discharge socket 16. Waste water which has flowed down into the toilet main body-side connecting pipe portion 20 bends from the flow path on the upstream side of the toilet main body-side connecting pipe portion 20 formed vertically downward from the descending pipe outlet portion 6*c* and flows toward the downstream side flow path formed in the horizontal direction of the toilet main body-side connecting pipe portion 20. Waste water which has passed through the downstream side flow path formed in the horizontal direction of the toilet main body-side connecting pipe portion 20 passes as is through the intermediate pipe portion 22, then flows into the under-floor plumbing-side connecting pipe portion 24.

As shown in FIG. 4, waste water flowing from the intermediate pipe portion 22 into the under-floor plumbing-side connecting pipe portion 24 first passes through the straight pipe portion 28 of the under-floor plumbing-side connecting pipe portion 24, then flows into the bent portion 30 of the under-floor plumbing-side connecting pipe portion 24 (F1). When the flow volume of waste water F1 flowing into the bent portion 30 from the straight pipe portion 28 is low, for example during a predetermined period from the start of discharge, waste water F1 which has passed through the straight pipe portion 28 flows into the bent portion 30, then flows downward as is (F2) (toward the vertical portion 32). Here a projecting portion 34 is erected in the bent portion 30 of the under-floor plumbing-side connecting pipe portion 24, in the flow direction of waste water F1 in the straight pipe portion 28. Therefore when the flow volume of waste water F1 flowing into the bent portion 30 from the straight pipe portion 28 increases, waste water F1 flows into the bent portion 30, then flows into the vertical portion 32 positioned below the bent portion 30 (F2), and into the interior of the projecting portion 34 of the projecting portion 34, positioned in the horizontal direction of the straight pipe portion 28 (F3).

The waste water F2 (mainstream) flowing from the straight pipe portion 28 downward toward the vertical portion 32 through the bent portion 30 flows toward the front wall surface 18*b* of the under-floor discharge pipe 18 in FIG. 4 under the force of the horizontal flow of waste water F1, which has flowed in from the straight pipe portion 28, and does not follow the wall surface 32*a* on the rear side of the vertical portion 32 in FIG. 4.

On the other hand, the waste water F3 flowing from the straight pipe portion 28 toward the projecting portion 34 through the bent portion 30 flows in essentially the horizontal direction, into the projecting space 34*a* formed by the projecting portion 34.

Here, because a pitched surface 34*e* sloping downward toward the outflow port 16*b* is erected on the bottom surface 34*c* of the projecting space 34*a* in the projecting portion 34, waste water flowing into the projecting space 34*a* in the projecting portion 34 accelerates and flows into the vertical portion 32. As a result, waste water F3 heading toward the vertical portion 32 through the projecting portion 34 flows toward the wall surface 18*c* of the under-floor discharge pipe 18 in FIG. 4, not flowing along the front wall surface 32*a* of the vertical portion 32 in FIG. 3.

In FIG. 4, the waste water F2 heading toward the wall surface 18*b* on the front side of the under-floor discharge pipe 18 merges with the waste water F3 flowing toward the wall surface 18*c* on the rear side of the under-floor discharge pipe 18. The horizontal flows of waste water F2 and waste water F3 thus cancel one another, and the waste water F2 flow direction is changed to the conduit center downward direction of the under-floor discharge pipe 18; i.e., to the center direction (center side) (F4) of the under-floor discharge pipe 18. Therefore compared to the case when there is no projecting space 34*a*, waste water following the under-floor discharge pipe 18 wall surface 18*b* diminishes, and waste water flowing down the area close to the center of the conduit cross section in the horizontal direction of the under-floor discharge pipe 18 increases. Therefore even when there is a bent portion 18*d* bending in the horizontal direction where the waste water flows down the under-floor discharge pipe 18 (the downstream side of the under-floor discharge pipe 18), the conduit cross section in the bent portion 18*d* is water sealed, and waste water flows without accumulating.

Note that when the merged waste water F4 flows down the vertical portion 32 and the outflow port 16*b*, no siphon action to suction discharge water in is manifested by the waste water F4.

In the discharge socket 16 and wash-down flush toilet 1 having same of the above-described first embodiment of the present invention, by disposing a projecting portion 34 projecting toward the horizontal direction further away from the center axis Y of the outflow port 16*b* than the outflow port 16*b*, a portion of water discharged to the under-floor plumbing-side connecting pipe portion 24 from the discharge trap conduit 6 on the toilet main body through the toilet main body-side connecting pipe portion 20 and the intermediate pipe portion 22 flows into the projecting space

34*a* of the projecting portion 34. Waste water flowing into the projecting space 34*a* on the projecting portion 34 flows toward the wall surface 18*c* at the rear side of the under-floor discharge pipe 18 and merges with the waste water mainstream flowing from the straight pipe portion 28 through the bent portion 30 toward the wall surface 18*b* on the front side of the under-floor discharge pipe 18, canceling out the horizontal flow (force and orientation). As a result, because the waste water mainstream falls into the center of the under-floor discharge pipe 18, not flowing along the wall surface of the under-floor discharge pipe 18, it can be prevented from accumulating in the bent portion 18*d* of the under-floor discharge pipe 18 and blocking the flow path, therefore the occurrence of siphoning can be prevented.

Using the discharge socket 16 and wash-down-type flush toilet 1 having same according to the first embodiment of the present invention, by placing a projecting portion 34 positioned opposite the straight pipe portion 28 side sandwiching the center axis Y of the outflow port 16*b* disposed at the bottom portion of the under-floor plumbing-side connecting pipe portion 24, water flowing in from the straight pipe portion 28 of the under-floor plumbing-side connecting pipe portion 24 to the bent portion 30 [thereof] more easily flows into the projecting space 34*a* of the projecting portion 34. Since water which has flowed into the projecting space 34*a* of the projecting portion 34 flows toward to the wall surface 18*c* on the rear side of the under-floor discharge pipe 18, the effect cancelling the horizontal flow (orientation and force) of the waste water mainstream can be further strengthened. As a result, because the waste water mainstream falls more to the center of the under-floor discharge pipe 18, it can be prevented from accumulating in the bent portion of the under-floor discharge pipe 18 and blocking the flow path, therefore the occurrence of siphoning can be further prevented.

In addition, using the discharge socket 16 and wash-down-type flush toilet 1 having same according to the first embodiment of the present invention, by forming a pitched surface 34*e* sloping downward toward the outflow port 16*b* placed on the bottom portion of the under-floor plumbing-side connecting pipe portion 24 on the bottom surface 34*c* of the projecting space 34*a* in the projecting portion 34, water flowing into the projecting space 34*a* of the projecting portion 34 flows more easily into the under-floor discharge pipe 18, and accumulation of water in the projecting space 34*a* on the projecting portion 34 can be prevented. Since the flow speed of reverse flowing water from the projecting space 34*a* formed by the projecting portion 34 increases, the force changing the direction of discharge water flowing along the wall surface of the under-floor discharge pipe 18 to the center of the under-floor discharge pipe 18 axis (the mainstream orientation and force cancellation effect) is strengthened, and the waste water mainstream falls into the center of the under-floor discharge pipe 18, not flowing along the wall surface 18*b* on the front side of the under-floor discharge pipe 18, so that water sealing of the under-floor discharge pipe 18 bent portion 18*d* can be constrained.

Using the discharge socket 16 and the wash-down flush toilet 1 having same of the first embodiment of the present invention, the following superior effects are additionally achieved. First, when waste which has piled up in the indented portion 12 of the bowl portion 4 of toilet main body 2 is discharged, a portion of the flush water accumulated in the indented portion 12 (advance flush water) flows into the discharge socket 16 in advance of the waste and is discharged to the under-floor discharge pipe 18; thereafter flush water (carrying water) which transports waste through by flowing behind waste water flows into the discharge socket 16, and waste is discharged to the under-floor discharge pipe 18 together with the flush water (carrying water).

However, when flush water is conserved, the amount of flush water (carrying water) for transporting waste declines, with the result that when water which has flowed into the under-floor discharge pipe 18 reaches the horizontal portion 18*f* of the under-floor discharge pipe 18, the distance over which waste can be transported shortens, producing the problem that waste cannot be discharged through the horizontal portion 18*f* of the under-floor discharge pipe 18.

Problems arising from the water conservation can be solved by the projecting space 34*a* formed on the projecting portion 34 of the bent portion 30 of toilet main body-side connecting pipe portion (vertical conduit portion) 20 in a discharge socket 16 according to the first embodiment of the present invention. I.e., even if the amount of flush water decreases due to water conservation, the beginning flow of advance flush water accumulates in the projecting space 34*a* when it flows through the discharge socket 16, then later flows into the under-floor discharge pipe 18. The timing of the flow of the advance flush water into the under-floor discharge pipe 18 is delayed according to the amount thereof accumulated in the projecting space 34*a*, with the result that this advance flush water which had been accumulating now flows into the under-floor discharge pipe 18 after waste flows down into the under-floor discharge pipe 18.

As a result, all or part of the advance flush can be utilized as carrying water for transporting waste, and the amount of carrying water can be increased, therefore in the horizontal portion 18*f* of the under-floor discharge pipe 18 waste can be reliably transported even when the amount of flush water is reduced due to water conservation.

The same advantageous effect of being able to utilize advance flush water as carrying water for transporting waste and reliably transporting waste in the horizontal portion 18*f* of the under-floor discharge pipe 18 by forming a projecting space 34*a* on the projecting portion 34 of the discharge socket 16 bent portion 30 can also be provided in the other embodiments and variations described below.

(Second Embodiment)

Figure 5:
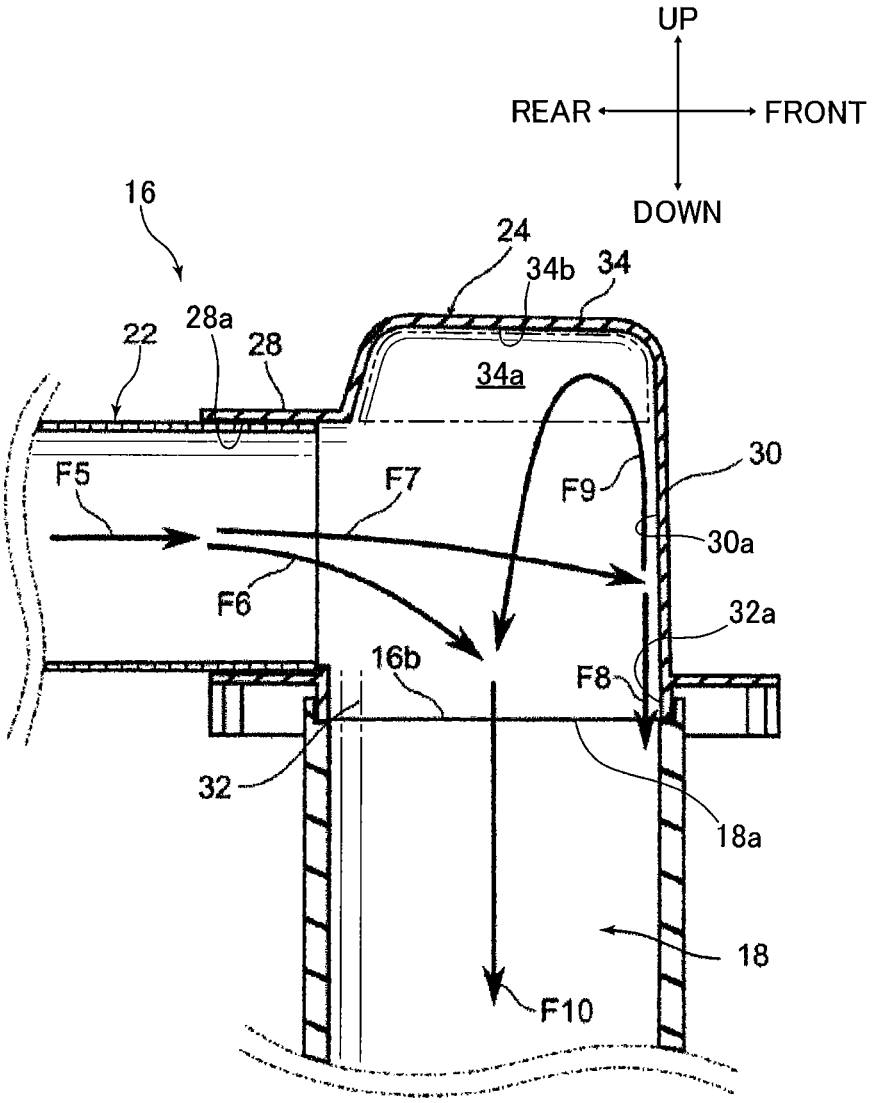
FIG. 5 is a cross sectional view of the under-floor-side plumbing-side connecting pipe portion schematically showing the discharge socket of the second embodiment of the present invention, and the flow in the discharge socket under-floor plumbing-side connecting pipe portion.

Next, referring to FIG. 5, a discharge socket 16 according to a second embodiment of the present invention is explained.

In a discharge socket 16 according to a second embodiment, a projecting portion 34 projecting toward the upward direction of the discharge socket 16 is disposed in the under-floor plumbing-side connecting pipe portion 24 bent portion 30. FIG. 5 is a cross sectional view of the under-floor-side plumbing-side connecting pipe portion, schematically showing the flow inside an under-floor plumbing-side connecting pipe portion in which a projecting portion is provided at the top of a discharge socket in the second embodiment of the present invention.

Under-floor Plumbing-Side Connection Portion

The discharge socket 16 according to the second embodiment is the same as the first embodiment except for the constitution of the under-floor plumbing-side connecting pipe portion 24, so a description thereof is omitted.

As shown in FIG. 5, the under-floor plumbing-side connecting pipe portion 24 has an outflow port 16*b* on bottom portion thereof, and has: a straight pipe portion 28 connected to the intermediate pipe portion 22 and extending horizontally; a bent portion 30, in which the flow path bends from the straight pipe portion 28 side toward the outflow port 16*b*; and a vertical portion 32 extending in the vertically downward direction from the bent portion 30 and connecting to the under-floor discharge pipe inlet portion 18*a*. An outflow port 16*b* is placed on the vertical portion 32, which is the bottom portion of the under-floor plumbing-side connecting pipe portion 24. The center axis of the outflow port 16*b* is an opening, the center axis of which is separated in the horizontal direction from the center axis of the vertical conduit of the toilet main body-side connecting pipe portion 20, and the outflow port 16*b* is connected to the under-floor discharge pipe inlet portion 18*a*.

A projecting portion 34 projecting toward the vertical upward direction of the outflow port 16*b* (the top of bent portion 30 in FIG. 5) is disposed on the bent portion 30 of under-floor plumbing-side connecting pipe portion 24. A projecting space 34*a* (the space surrounded by the double dot and dash line in FIG. 5), communicating with the bending flow path of bent portion 30, is formed on the interior of the projecting portion 34. In the bent portion 30 of the under-floor plumbing-side connecting pipe portion 24, the projecting portion 34 is placed in a position facing the portion connecting the bent portion 30 and the vertical portion 32, sandwiching the center axis X of the straight pipe portion 28. More specifically, the projecting space 34*a* in the projecting portion 34 is a space which communicates with the bending flow path of the bent portion 30, which projects on the upward side further than the top surface 28*a* of the straight pipe portion 28 of the bent portion 30 in FIG. 5.

The side surface on the rear side of the projecting portion 34 in FIG. 5 is formed to extend vertically upward from the end portion of the straight pipe portion 28 at a vertically upward position on the front side wall surface of the vertical portion 32. The top surface 34*b* of the projecting portion 34 is formed so as to extend essentially horizontally from the side surface at the rear side of the projecting portion 34 toward the front. I.e., the top surface 34*b* of the projecting portion 34 is formed above the top surface 28*a* of the straight pipe portion 28. The front side surface of the projecting portion 34 is formed to face vertically downward from the top surface 34*b* of the projecting portion 34 at a position vertically above the wall surface 32*a* on the front side of the vertical portion 32, and is connected to the side wall on the front side of the bent portion 30.

Operation and Effect

Next, it is explained the flow of waste water in the under-floor plumbing-side connecting pipe portion 24 when a projecting portion 34 is erected at the top of the bent portion 30.

As shown in FIG. 5, waste water flowing from the intermediate pipe portion 22 into the under-floor plumbing-side connecting pipe portion 24 first passes through the straight pipe portion 28 of the under-floor plumbing-side connecting pipe portion 24, then flows into the bent portion 30 of the under-floor plumbing-side connecting pipe portion 24 (F5). When the flow volume of waste water F5 flowing into the bent portion 30 from the straight pipe portion 28 is low, for example during a predetermined period from the start of discharge, waste water F5 passing through the straight pipe portion 28 flows into the bent portion 30, then flows downward as is (F6). Thereafter, when the flow volume of waste water F5 becomes high, a portion of the waste water F5 flowing into the bent portion 30 flows into the vertical portion 32 positioned below the bent portion 30 (F6), and a portion collides with the wall surface 30*a* on the front side of the bent portion 30 (F7).

The waste water F6 (mainstream) flowing from the straight pipe portion 28 downward toward the vertical portion 32 through the bent portion 30 flows toward the front side wall surface 18*b* of the under-floor discharge pipe 18 in FIG. 5 under the force of the horizontal flow of waste water F5, which has flowed in from the straight pipe portion 28, and does not follow the wall surface 32*a* on the rear side of the vertical portion 32 in FIG. 5.

On the other hand, the waste water F7 colliding with the wall surface 30*a* on the front side of the bent portion 30 respectively flows upward (F8) and downward (F9) along the front side wall surface 30*a* of the bent portion 30. Waste water F8 flowing downward along the front wall surface 30*a* of the bent portion 30 flows down along the wall surface 32*a* on the front side of the vertical portion 32 and the wall surface 18*b* on the front side of the under-floor discharge pipe 18. Waste water F9 flowing upward along the wall surface 30*a* of the bent portion 30 circulates in the projecting space 34*a* of the projecting portion 34 so as to follow the wall surface inside the conduit of the projecting portion 34, in the sequence of front side of the projecting portion 34 and top surface of projecting portion 34. Circulated waste water F9 flows down toward the center of the vertical portion 32.

Waste water F6, which flowed toward wall surface on the front side of the under-floor discharge pipe 18, merges with waste water F9, which circulates in the projecting space 34*a* of the projecting portion 34 and flows down toward the center of the vertical portion 32. The downward flow of waste water F9 cancels the front-heading flow of waste water F6, and the flow direction of waste water F6 is changed to a conduit center downward orientation in the under-floor discharge pipe 18 (F10). Therefore compared to the case when there is no projecting space 34*a*, waste water following the under-floor discharge pipe 18 side wall, e.g. waste water F8, decreases, and waste water flowing down close to the center region of the conduit cross section in the horizontal direction of the under-floor discharge pipe 18 increases. Therefore even when there is a bent portion 18*a* bending in the horizontal direction where the waste water flows down the under-floor discharge pipe 18, the conduit cross section in the bent portion 18*a* is water sealed, and waste water flows without accumulating.

In the discharge socket 16 and wash-down flush toilet 1 having same of the second embodiment of the present invention, by disposing a projecting portion 34 projecting in the vertically upward direction of outflow port 16*b*, a portion of water discharged to the under-floor plumbing-side connecting pipe portion 24 from the discharge trap conduit 6 on the toilet main body through the toilet main body-side connecting pipe portion 20 and the intermediate pipe portion 22 flows into the projecting space 34*a* formed by the projecting portion 34. Waste water flowing to the projecting space 34*a* formed by the projecting portion 34 flows toward the wall surface at the rear side of the under-floor discharge pipe 18 and merges with the mainstream of waste water flowing from the straight pipe portion 28 through the bent portion 30 toward the wall surface on the front side of the under-floor discharge pipe 18 canceling out the horizontal flow (force and orientation). As a result, because the mainstream of waste water falls into the center of the under-floor discharge pipe 18, not flowing along the wall surface of the under-floor discharge pipe 18, it can be prevented from accumulating in the bent portion of the under-floor discharge pipe 18 and blocking the flow path, therefore the occurrence of siphoning can be prevented.

Figure 6:
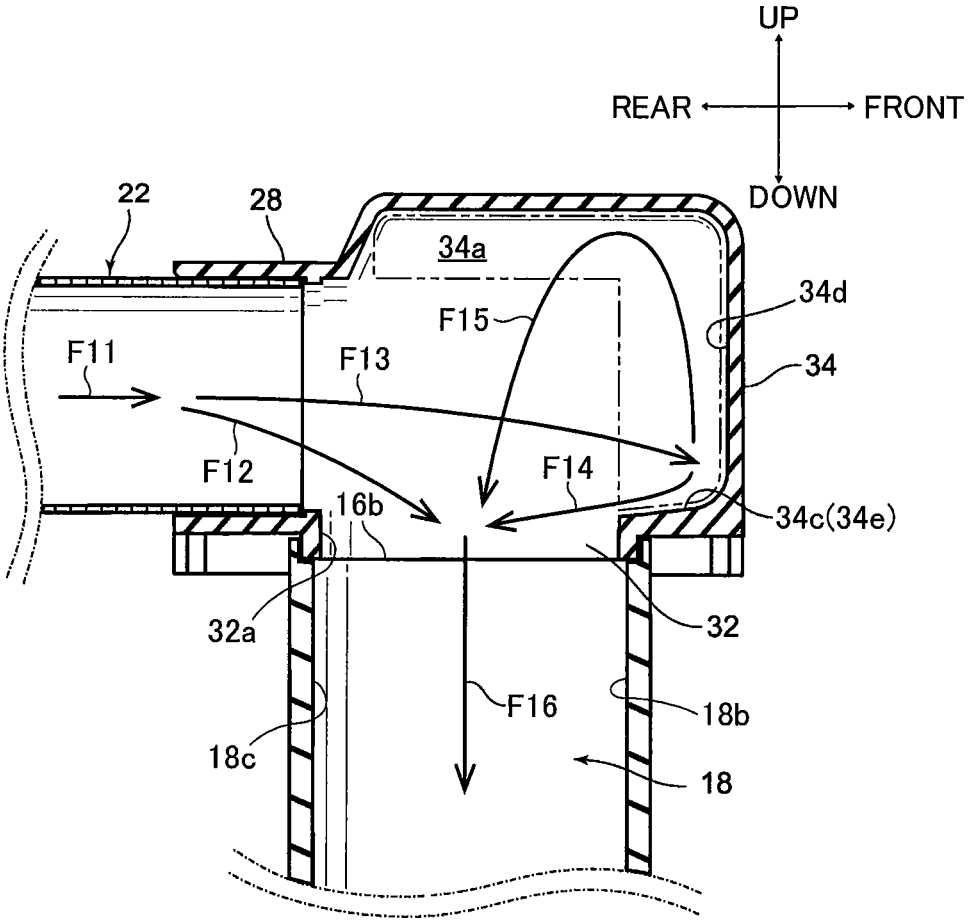
FIG. 6 is a cross sectional view of the under-floor-side plumbing-side connecting pipe portion schematically showing the discharge socket of the third embodiment of the present invention, and the flow in the discharge socket under-floor plumbing-side connecting pipe portion.

Next, referring to FIG. 6, the third embodiment of the present invention is explained. FIG. 6 is a cross sectional view of the under-floor-side plumbing-side connecting pipe portion schematically showing the discharge socket of the third embodiment of the present invention, and the flow in the discharge socket under-floor plumbing-side connecting pipe portion. The third embodiment includes the constitutions of both the above-described first embodiment and second embodiment. A detailed structural explanation is therefore omitted.

A discharge socket 16 according to the third embodiment comprises an under-floor plumbing-side connecting pipe portion (bent conduit portion) 24, and a straight pipe portion 28, bent portion 30, and vertical portion 32 are formed on this under-floor plumbing-side connecting pipe portion (bent conduit portion 24). A projecting portion 34 is formed on the bent portion 30, and on the projecting portion 34 the projecting space 34*a*, which is the space surrounded by a double dot and dash line in FIG. 6, is formed over the flow path 16*c* along the center axis Y of the outflow port 16*b*, and on the front side of the flow path 16*c*.

Next, the operation and action of the third embodiment is explained. As shown in FIG. 6, waste water flowing from the intermediate pipe portion 22 into the under-floor plumbing-side connecting pipe portion 24 first passes through the straight pipe portion 28 of the under-floor plumbing-side connecting pipe portion 24, then flows into the bent portion 30 of the under-floor plumbing-side connecting pipe portion 24 (F11). When the flow volume of waste water F11 flowing into the bent portion 30 from the straight pipe portion 28 is low, for example during a predetermined time from the start of discharge waste water F11 passing through the straight pipe portion 28 flows into the bent portion 30, then flows downward as is (F12). Thereafter, when the flow volume of waste water F11 becomes high, a portion of the waste water F11 flowing into the bent portion 30 flows into the vertical portion 32 positioned below the bent portion 30 (F12), and a portion collides with the wall surface 34*d* on the front side of the projecting portion 34 (F13).

The waste water F12 (mainstream) flowing from the straight pipe portion 28 downward toward the vertical portion 32 through the bent portion 30 flows toward the front side wall surface 18*b* of the under-floor discharge pipe 18 in FIG. 6 under the force of the horizontal flow of waste water F11, which has flowed in from the straight pipe portion 28, and does not follow the wall surface 32*a* on the rear side of the vertical portion 32 in FIG. 6.

On the other hand, the waste water F13 which collided with the wall surface 33*c* on the front side of the projecting portion 34 flows toward the wall surface 18*c* on the rear side of the under-floor discharge pipe 18 (F14), and flows upward along the wall surface 33*c* on the front side of the projecting portion 34 (F15). Waste water F15 which flows upward along the wall surface 34*d* of the projecting portion 34 then flows down toward the center of the vertical portion 32.

Waste water F12 flowing toward the wall surface 18*b* on the front side of the under-floor discharge pipe 18 merges with the waste water F14 and F15 flowing down toward the center of the above-described vertical portion 32. The downward flow of waste water F14 and F15 cancels the frontward flow of waste water F12, and the flow direction of waste water F12 is changed to a conduit center downward orientation in the under-floor discharge pipe 18 (F16). Hence, compared to the case when there is no projecting space 34*a*, waste water flowing down close to the center of the conduit cross section in the horizontal direction of the under-floor discharge pipe 18 increases. Therefore even when there is a bent portion 18*a* bending in the horizontal direction where the waste water flows down the under-floor discharge pipe 18, the conduit cross section in the bent portion 18*a* is water sealed, and waste water flows without accumulating.

(Variations)

Above embodiments of the present invention have been explained, but the present invention is not limited to the above-described embodiments.

Figure 7:
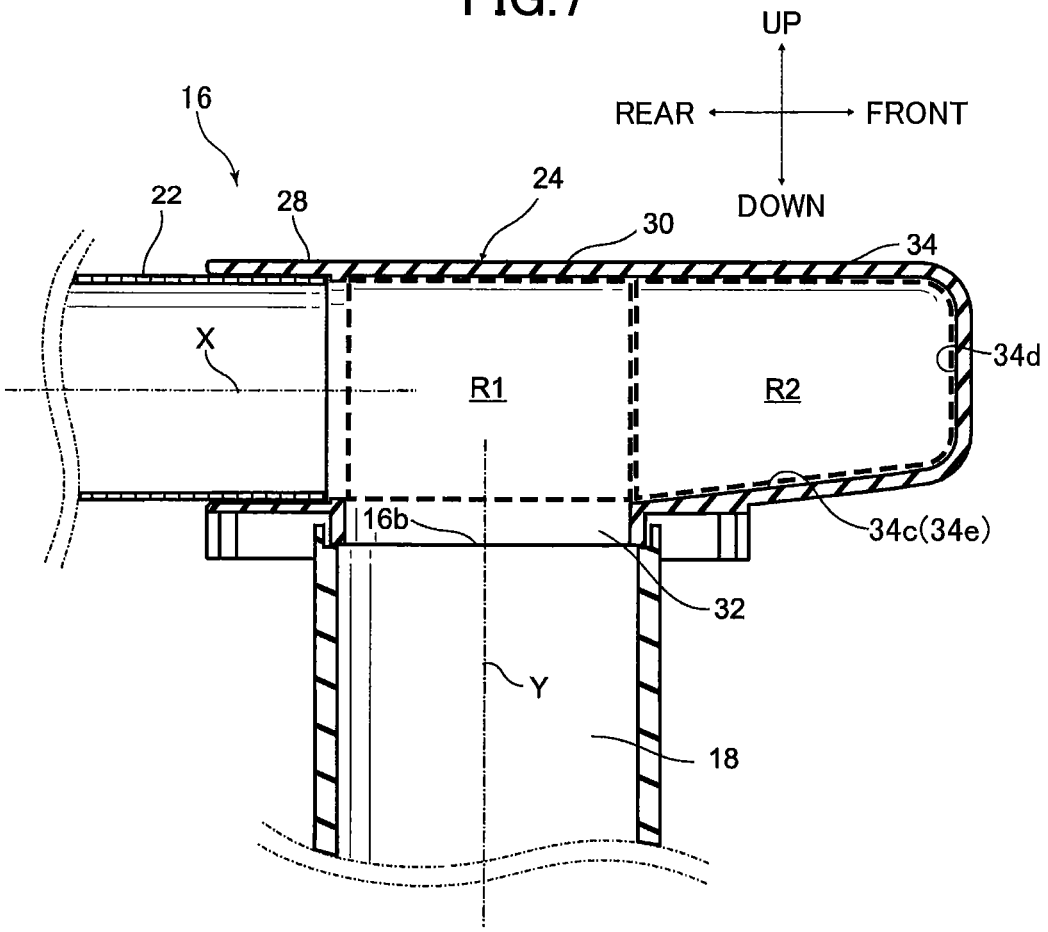
FIG. 7 is a cross sectional view showing the under-floor plumbing side connecting pipe portion of a discharge socket according to a variation of the first embodiment of the invention.

First, referring to FIG. 7, a discharge socket according to a variation of the first embodiment of the present invention is explained. FIG. 7 is a cross sectional view showing an under-floor plumbing side connecting pipe portion of a discharge socket according to a variation of the first embodiment of the present invention.

As shown in FIG. 7, in a discharge socket 16 according to the variation, the volume R2 of the projecting space 34*a* which communicates with the bent flow path of the bent portion 30 is constituted to be larger than the virtual cylinder volume R1, which is formed by projecting the opening cross section in the horizontal direction of the outflow port 16*b* from the height position of the bottom surface to the height position of the top surface of the bent portion 30 inside the bent flow path of the bent portion 30 of the under-floor plumbing-side connecting pipe portion 24. Note that in the variation as well, it is also acceptable for a pitched surface 34*e* sloping downward toward the outflow port 16*b* to be formed on the bottom surface 34*c* of the projecting space in the projecting portion 34.

Since the volume R2 of the projecting space 34*a* formed by the projecting portion 34 is larger than the volume R1 of the space inside the conduit of the bent portion 30 on which the opening cross section in the horizontal direction of 16*b* is projected from the height position of the bottom surface of the bent portion 30 to the height position of the top surface, a greater amount of waste water flows into the projecting space on the projecting portion 34. And since the amount of water flowing in reverse from the space increases with the volume of the projecting space 34*a* on the projecting portion 34, the force changing the direction of discharge water flowing along the wall surface of the under-floor discharge pipe 18 to the center of the under-floor discharge pipe 18 axis (the mainstream orientation and force cancellation effect) is strengthened, and the waste water mainstream falls into the center of the under-floor discharge pipe 18, not flowing along the wall surface 18*b* on the front side of the under-floor discharge pipe 18, so that water sealing of the bent portion 18*d* of the under-floor discharge pipe 18 can be constrained.

Note that in the above-described embodiment of the invention, the three portions consisting of the toilet main body-side connecting pipe portion 20 of the discharge socket 16, the intermediate pipe portion 22, and the under-floor plumbing-side connecting pipe portion 24 were constituted as separate bodies, but they may be also be formed as a single piece. It is also possible to form two of the three parts as a single piece.

Figure 8:
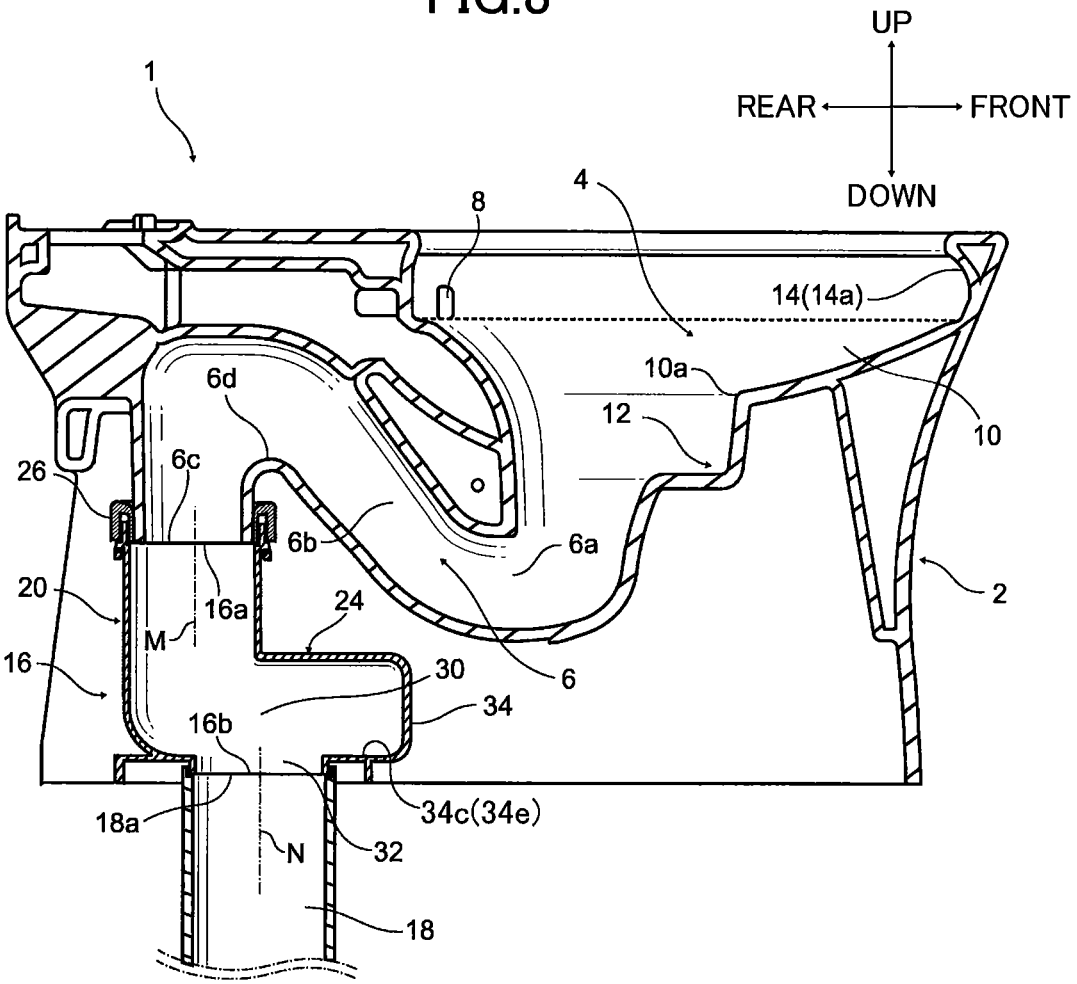
FIG. 8 is a cross sectional view showing a discharge socket according to another variation example of the first embodiment of the present invention and a wash-down flush toilet having the discharge socket.
Figure 9:
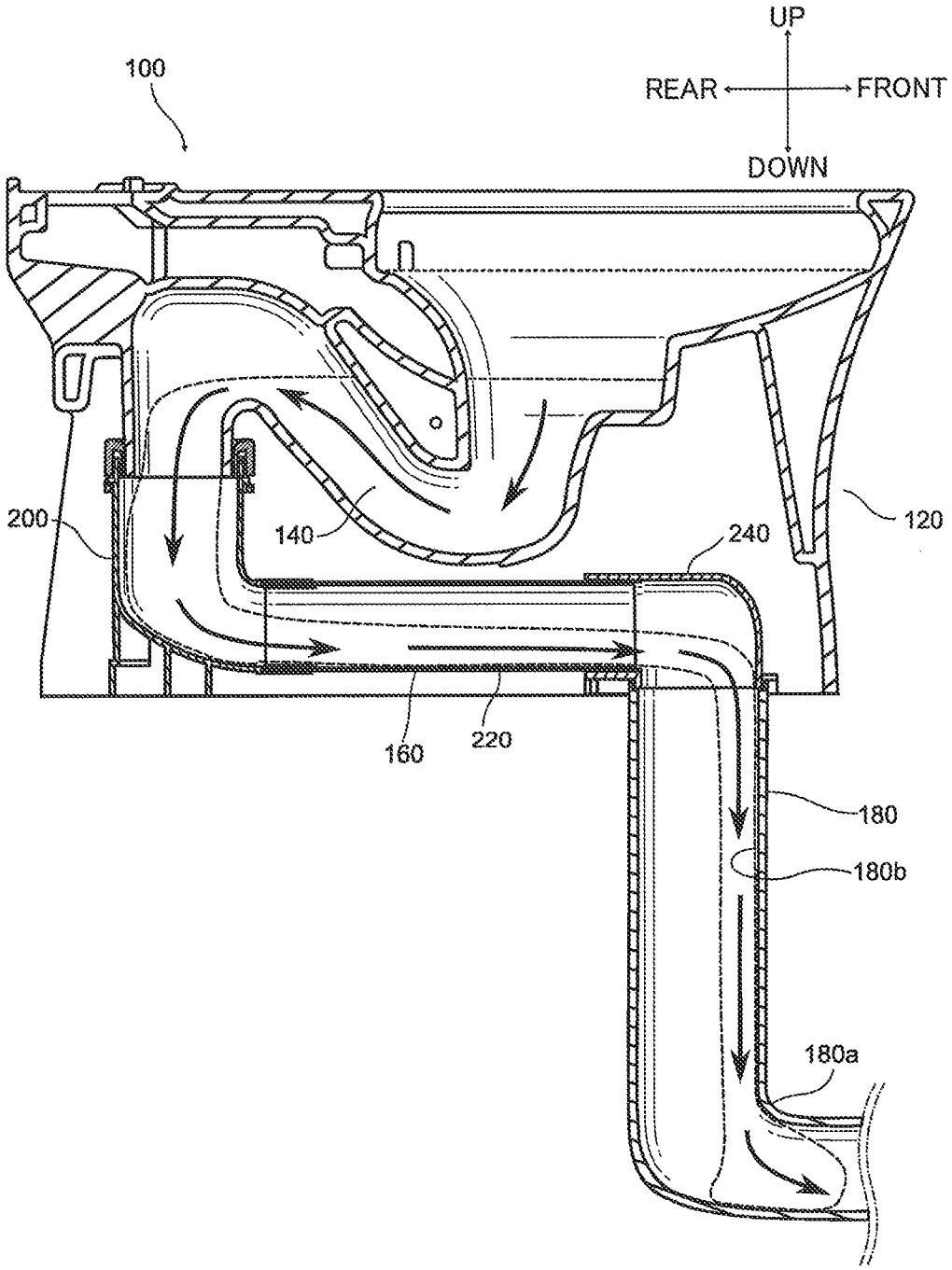
FIG.9 PRIOR ART
FIG. 9 is a cross sectional view schematically showing a wash-down flush toilet having a conventional discharge socket, and the flow of discharge water in an under-floor discharge pipe having a bent portion.

Next, referring to FIG. 8, a discharge socket according to another variation of the first embodiment of the present invention is explained. FIG. 8 is a cross sectional view of a discharge socket according to another variation of the first embodiment of the present invention and a wash-down flush toilet having the discharge socket.

As shown in FIG. 8, in this variation, the intermediate pipe portion 22 is omitted in the discharge socket 16, the upstream part of the intermediate pipe portion 22 is formed as a single piece with the toilet main body-side connecting pipe portion 20, and the downstream side part of the intermediate pipe portion 22 is formed as a single piece with the under-floor plumbing-side connecting pipe portion 24. Note that in FIG. 8 the center axis of the inflow port 16*a* is indicated by M, and the outflow port 16*b* by N.

As shown in FIG. 8, when the trap descending pipe outlet portion 6*c* is viewed from above, the toilet main body 2 is disposed at a position where the conduit cross section in the horizontal direction of the trap descending pipe outlet portion 6*c* and the conduit cross section in the horizontal direction of the under-floor discharge pipe inlet portion 18*a* overlap. In addition, the discharge socket 16 comprises a toilet main body-side connecting pipe portion 20, connected in the vertically downward direction to the trap descending pipe outlet portion 6*c* of the toilet main body 2 and formed so as to bend from the vertically downward direction toward the horizontal direction; and an under-floor plumbing-side connecting pipe portion 24, connected to the downstream side of the toilet main body-side connecting pipe portion 20 and formed so as to bend from the horizontal direction toward the vertically downward direction. The toilet main body-side connecting pipe portion 20 and the under-floor plumbing-side connecting pipe portion 24 are formed as a single piece.

In the toilet main body-side connecting pipe portion 20, an inflow port 16*a* disposed on the toilet main body-side connecting pipe portion 20 though rubber joint 26 is connected to the trap descending pipe outlet portion 6*c* opening in the vertical downward direction of the discharge trap conduit 6 on the toilet main body 2. The toilet main body-side connecting pipe portion 20 is formed so that the flow path inside the toilet main body-side connecting pipe portion 20 bends, from the vertically downward upstream side to the horizontal upstream side. The under-floor plumbing-side connecting pipe portion 24 is connected on the downstream side of the toilet main body-side connecting pipe portion 20.

The upstream side of the under-floor plumbing-side connecting pipe portion 24 is formed as a single piece with the downstream side of the toilet main body-side connecting pipe portion 20, and the under-floor plumbing-side connecting pipe portion 24 has an outflow port 16*b* in the bottom portion. On the downstream side of the under-floor plumbing-side connecting pipe portion 24, a bent portion 30 is disposed in which the flow path bends vertically downward (outflow port 16*b*) from the horizontal flow path which is on the downstream side of the toilet main body-side connecting pipe portion 20 and the upstream side of the under-floor plumbing-side connecting pipe portion 24. A vertical portion 32, which extends vertically downward from the bent portion 30, and on which an outflow port 16*b* is opened, is disposed on the bottom portion of the under-floor plumbing-side connecting pipe portion 24. The under-floor plumbing-side connecting pipe portion 24 is connected to the under-floor discharge pipe inlet portion 18*a* through this outflow port 16*b*. A projecting portion 34 projecting in a direction away from the center axis N of the outflow port 16*b* is disposed on the front side of the bent portion 30 in FIG. 8. A projecting space communicating with the bending flow path of the bent portion 30 is formed within this projecting portion 34.

Note that it is acceptable for a pitched surface 34*e* sloping downward toward the outflow port 16*b* to be formed on the bottom surface 34*c* of the projecting space in the projecting portion 34.

Also, in the above-described embodiment and variation of the present invention, the shapes of the conduit cross section of the straight pipe portion 28 in the plane perpendicular to the straight pipe portion 28 center axis X and the conduit cross section of the projecting portion 34 may, for example, be different, and the shape of the conduit cross section of the projecting portion 34 in the plane perpendicular to the straight pipe portion 28 center axis X may be a polygon shape. It is also acceptable for the conduit cross section of the projecting portion 34 in the plane perpendicular to the center axis X of the straight pipe portion 28 to be formed so as to become gradually smaller or larger from the bent portion 30 toward the projecting portion 34.

The source of flush water supplied to the toilet main body 2, for example, is not limited to a tank system such as the reservoir tank (not shown) indicated in the above-described embodiments, and may be of a municipal water direct pressure type directly utilizing municipal supply pressure, or a flush valve system, or a flush water supply using supplemental pressure from a pump.

The respective conduits in the discharge trap conduit 6 and toilet main body-side connecting pipe portion 20, intermediate pipe portion 22, under-floor plumbing-side connecting pipe portion 24, and under-floor discharge pipe 18 may also be connected by welding, for example, or may be joined using adhesive or the like. Or, conduits and pipes may be connected together by disposing a seal portion at the connecting parts of the respective conduits and pipes.

Alternatively, for example, the under-floor plumbing-side connecting pipe portion 24 straight pipe portion 28 and intermediate pipe portion 22 do not have to be completely horizontal relative to the floor surface, but may be pitched upward or downward from the upstream to the downstream side of the straight pipe portion 28 to a sufficient extent to impart an effect. Specifically, the slope angle from the floor surface should be 45 degrees or less.

For example, a constitution in which a projecting portion 34 is disposed at a position sandwiching the center axis Y of the outflow port 16*b* more than the outflow port 16*b*, facing the straight pipe portion 28 side (the toilet main body-side connecting pipe portion 20 side) in the bent portion 30, and a constitution in which a projecting portion 34 is disposed projecting vertically upward on the outflow port 16*b* is explained, but it is also acceptable to form the projecting portion 34 by making the bent portion 30 conduit project so as to separate from the center axis Y of the outflow port 16*b* in the left-right direction when the bent portion 30 of the under-floor plumbing-side connecting pipe portion 24 is seen from the discharge socket 16. In addition, all of the above or a portion thereof may be connected to form the projecting portion 34.

The constitution in which, for example, a discharge socket 16 is connected to what is known as an under-floor discharge-type of wash-down flush toilet 1 in which the trap descending pipe outlet portion 6*c* is opened vertically downward, but what is known as a wall discharge-type wash-down flush toilet 1 may also be used, in which a trap descending pipe outlet portion 6*c* is horizontally opened in the toilet main body 2 discharge trap conduit 6, and a flow path inside the discharge trap conduit 6 between the trap conduit peak portion 6*d* and the trap descending pipe outlet portion 6*c* bends in the horizontal direction.

Also, in the toilet main body-side connecting pipe portion 20, the constitution in which, for example, the flow path on the upstream side inside the toilet main body-side connecting pipe portion 20 is formed in the vertical direction has been explained, but the upstream side flow path inside the toilet main body-side connecting pipe portion 20 may also bend to the rear side of the toilet main body 2.

It is also acceptable, for example, to dispose on the projecting portion 34 a resisting portion for constraining the penetration of waste into the projecting space 34*a*. Since the penetration of waste into the projecting space 34*a* can be constrained by the resisting portion, waste does not flow into the under-floor discharge pipe 18, and can be constrained from accumulating in the projecting space 34*a*. The resisting portion may, for example, be a raised portion projecting upward from the bottom surface 34*c* of the projecting portion 34.

What is claimed is:

1. A discharge socket configured to connect a discharge port of a toilet main body and a discharge pipe which includes a bent portion, the discharge socket comprising:

a vertical conduit portion having an inlet port configured to connect to the discharge port of a toilet main body and bending from a vertical direction into a horizontal direction in a horizontal conduit portion; and a bent conduit portion including an outflow port configured to connect to an inlet port of the discharge pipe and having a center axis of the outflow port separated in the horizontal direction from a center axis of the vertical conduit portion; and a bent portion which bends a flow path from the horizontal direction in the horizontal conduit portion toward the outflow port of the bent conduit portion;

wherein a projecting portion is disposed on the bent portion of the bent conduit portion and protrudes outwardly from the bent portion of the bent conduit portion to form a projecting space, the projecting space in the projecting portion being formed above the outflow port, a bottom surface of the projecting space in the projecting portion being formed at a same height position as a bottom surface of the horizontal conduit portion extending in the horizontal direction, and the projecting portion is formed so that the flow direction of discharge water flowing from the horizontal conduit portion to the bent conduit portion and into the inlet port of the discharge pipe is directed to a center direction of the outflow port by the discharge water flowing from the projecting space and merging with the discharge water flowing from the flow path.

2. The discharge socket according to claim 1, wherein the projecting portion on the bent portion of the bent conduit portion is disposed on an opposite side from a vertical conduit portion side, with the center axis of the outflow port of the bent conduit portion positioned between the projecting portion and the vertical conduit portion.

3. The discharge socket according to claim 2, wherein a volume of the projecting space in the bent conduit portion is greater than a volume of a virtual cylinder which is defined as a height of the bent conduit portion and a width of the outflow port of the bent conduit portion.

4. The discharge socket according to claim 2, wherein the bottom surface of the projecting space of the bent conduit portion forms a pitched surface sloping downward toward the outflow port of the bent conduit portion.

5. A flush toilet comprising the discharge socket according to claim 1.

* * * * *